US005203303A

United States Patent [19]

Collingborn et al.

[11] Patent Number: 5,203,303

[45] Date of Patent: Apr. 20, 1993

[54] FUEL PUMPING APPARATUS

[75] Inventors: Peter A. G. Collingborn; Kenenth M. Harris; Derek W. Tomsett, all of Kent, England

[73] Assignee: Lucas Industries, West Midlands, England

[21] Appl. No.: 636,727

[22] Filed: Jan. 2, 1991

[30] Foreign Application Priority Data

Jan. 25, 1990 [GB] United Kingdom ..... 9001736

[51] Int. Cl.[5] ..... F02M 41/00

[52] U.S. Cl. ..... 123/450; 123/506; 417/462

[58] Field of Search ..... 123/450, 506, 385, 386, 123/387, 373; 417/462

[56] References Cited

U.S. PATENT DOCUMENTS

| | | | |
|---|---|---|---|
| 3,101,079 | 8/1963 | Evans | 123/450 |
| 3,339,534 | 9/1967 | Eheim et al. . | |
| 3,385,219 | 5/1968 | Eckert . | |
| 3,485,225 | 12/1969 | Bailey | 123/450 |
| 4,759,694 | 7/1988 | Thornwaite | 417/462 |
| 4,920,940 | 5/1990 | Harris | 123/450 |
| 4,936,755 | 6/1990 | Greeves | 417/462 |
| 5,005,548 | 4/1991 | Rembold | 123/506 |
| 5,012,785 | 5/1991 | Long | 123/506 |
| 5,035,587 | 7/1991 | Collingborn | 417/462 |
| 5,044,345 | 9/1991 | Collingborn | 123/450 |
| 5,044,896 | 9/1991 | Genster . | |

FOREIGN PATENT DOCUMENTS

| | | | |
|---|---|---|---|
| 1122886 | 8/1968 | United Kingdom . | |
| 0381343 | 8/1990 | United Kingdom | 123/450 |

*Primary Examiner*—Carl S. Miller
*Attorney, Agent, or Firm*—Staas & Halsey

[57] ABSTRACT

A rotary distributor fuel pumping apparatus includes a cam actuated pumping plunger which delivers fuel to a plurality of outlets in turn during successive inward movements. A spill valve is provided which can be opened when fluid pressure is applied to a piston to spill fuel from the bore. An auxiliary plunger delivers fluid under pressure which can be applied to the piston through a control valve. The control valve includes an annular spring loaded component which is moved by the fluid pressure and an angularly adjustable rod which is surrounded by the component. The rod is provided with a helical groove and the component with a slot and when these are brought into communication fluid under pressure is applied to the piston.

7 Claims, 4 Drawing Sheets

FUEL PUMPING APPARATUS

BACKGROUND OF THE INVENTION

Summary of the Invention

This invention relates to a fuel pumping apparatus for supplying fuel to an internal combustion engine and of the kind comprising a rotary distributor member journalled in a pump body and arranged to be driven in use in timed relationship with the associated engine, a pumping plunger mounted in a bore in the distributor member, cam means for imparting inward movement to the plunger, a delivery passage in the distributor member in communication with the bore, the delivery passage registering in turn with a plurality of outlets in the pump body during successive inward movements of the pumping plunger, a spill valve operable to allow fuel to spill from the bore, a fluid pressure operable piston for actuating the spill valve, an auxiliary plunger carried by the distributor member, the auxiliary plunger being operated at the same time as the pumping plunger, and a control valve including a fluid pressure operable component movable by the fluid delivered by said auxiliary plunger, said control valve controlling the application of fluid under pressure to said piston.

The object of the present invention is to provide an apparatus of the kind specified in a simple and convenient form.

According to the invention the control valve at a predetermined position in the movement of said component opens to apply the fluid under pressure delivered by said auxiliary plunger to said piston.

According to a further feature of the invention said control valve comprises an outer fixed member defining a cylindrical bore, an inner member in the form of an angularly adjustable rod, said component being of annular form and being slidably located between the inner and outer members, said annular component at one end being exposed to the pressure of fluid delivered by said auxiliary plunger, resilient means for opposing the movement of the component and valve means defined by the component and the rod whereby after a predetermined axial movement of the component against the action of the resilient means and depending on the relative angular position of the component and the rod, the valve means opens to allow the fluid pressure developed by the auxiliary plunger to act on said piston.

According to a still further feature of the invention the rod is coupled to a governor mechanism and the component is angularly adjustable in accordance with an engine operating parameter.

BRIEF DESCRIPTION OF THE DRAWINGS

One example of a fuel injection pumping apparatus in accordance with the invention will now be described with reference to the accompanying drawings in which.

DESCRIPTION OF THE PREFERRED EMBODIMENTS

Figure 1:
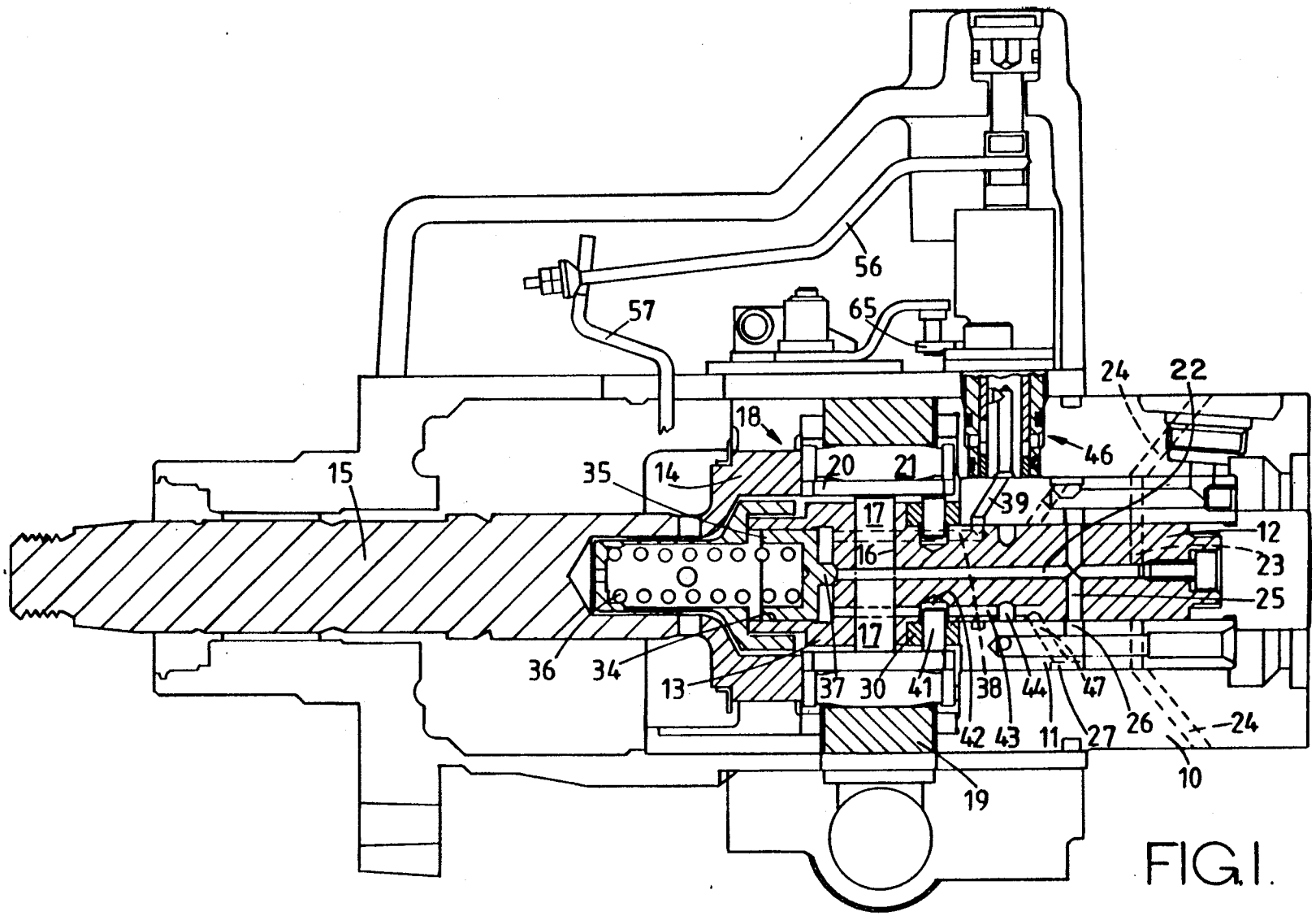
FIG. 1 is a sectional side elevation of the apparatus.

Referring to FIG. 1 of the drawings the apparatus comprises a multi-part body 10 in one portion of which is mounted a sleeve 11 in which is journalled a rotary cylindrical distributor member 12. The distributor member has an enlarged portion 13 which is located within a space defined in the body 10 and extending into the space and having an enlarged hollow portion 14 surrounding the enlarged portion of the distributor member. A drive shaft 15 is journalled for rotation within the body 10. The drive shaft is arranged to be driven in use in timed relationship with the associated engine.

Formed in the enlarged portion 13 of the distributor member is a transverse bore 16 in which is mounted a pair of pumping plungers 17. A further bore together with the associated plungers may be provided. The plungers 17 at their outer ends, are engaged by cam followers 18 respectively which are interposed between the plungers and the internal peripheral surface of an annular cam ring 19 mounted within the pump body. Each cam follower comprises a shoe 20 and a roller 21, the latter engaging the internal surface of the cam ring. The followers are located in slots formed in the enlarged portion 14 of the drive shaft 15 so as to be driven directly thereby.

Figure 4:
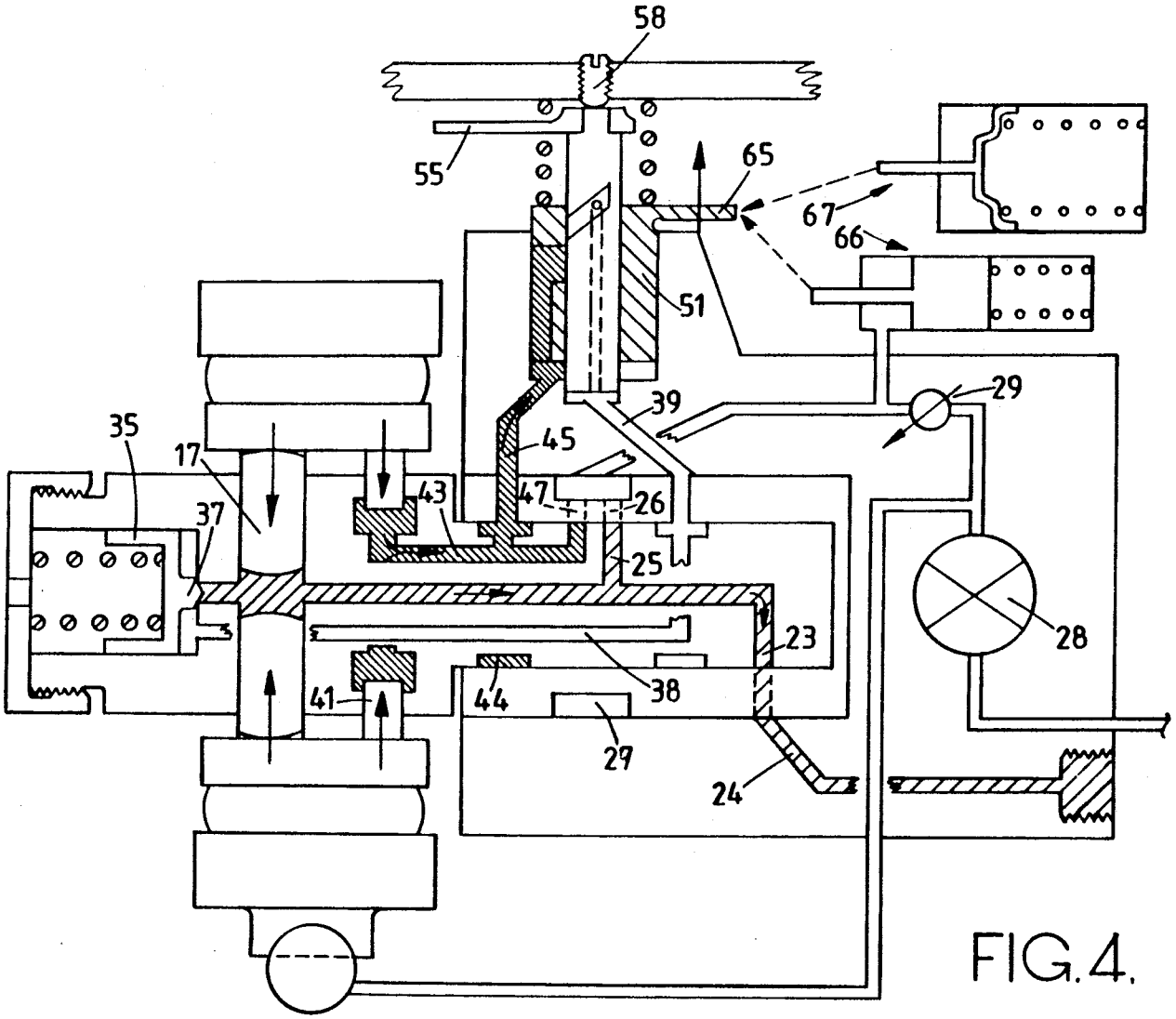
FIG. 4 is a fuel circuit diagram of the apparatus seen in FIG. 1.

Extending axially within the distributor member is a longitudinal passage 22 which at one point communicates with a radially disposed delivery passage 23 which is positioned to register in turn with a plurality of outlets 24 which in use are connected to the injection nozzles respectively of the associated engine. The passage 22 also communicates with a plurality of radially disposed inlet passages 25 and these register in turn with inlet ports 26 formed in the sleeve 11. The outer ends of the ports 26 communicate with a circumferential groove 27 and this groove communicates as shown in FIG. 4, with the outlet of a low pressure supply pump 28 the output pressure of which is controlled by means of a suitable valve not shown so that it varies in accordance with the speed at which the apparatus is driven. Conveniently a stop valve 29 is provided intermediate the outlet of the pump and the groove 27.

In operation, following outward movement of the pumping plungers 17 under the action of fuel supplied to the bore 16 through the passage 22 and the passages 25 and ports 26, the plungers will be moved inwardly by the cam lobes during which time the delivery passage 23 is in register with an outlet 24 so that fuel displaced from the bore 16 will be supplied to an engine cylinder. Following delivery of fuel to the associated engine, further fuel is supplied to the bore 16 and the process is repeated with the engine cylinders receiving fuel in turn.

Figure 2:
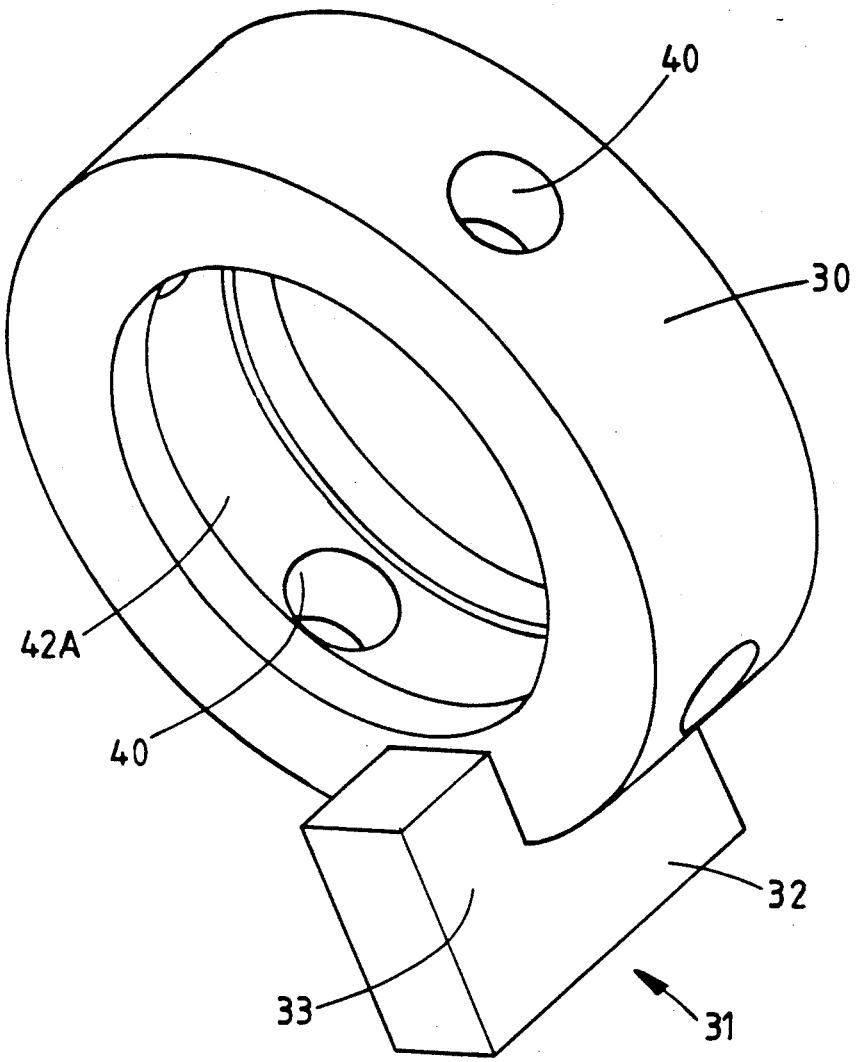
FIG. 2 is a perspective view to an enlarged scale of part of the apparatus seen in FIG. 1.

As will be observed the end portion of the enlarged portion 13 of the distributor member is occupied by a mechanism to be described and in order to couple the drive shaft with the distributor member, there is located about the distributor member an annular member 30 which is seen to a much enlarged scale in FIG. 2. The annular member is a close fit about a portion of the distributor member which projects from the sleeve 11 and is located between the sleeve and the adjacent face of the enlarged portion of the distributor member. Integrally formed with the annular member is a drive block 31 and this defines a first portion 32 which extends outwardly from the annular member 30 and is engaged within an axial slot formed in the enlarged portion 14 of the drive shaft. The block 31 defines a second portion 33 which extends axially and is located within a slot formed in the enlarged portion 13 of the distributor member. In this manner the distributor member is coupled to the enlarged portion 14 of the drive shaft and the block is formed so that it is of sufficient strength so that in the event of seizure of the distributor member within the sleeve 11, sufficient torque will be transmitted to ensure that the distributor member will shear at or adjacent the end of the sleeve.

Formed in the end of the enlarged portion 13 of the distributor member is a cylinder 34 in which is slidably mounted a cup shaped piston 35 which is biased towards the base wall of the cylinder by means of one, (as illustrated) or more, coiled compression springs 36, the latter being accommodated within a housing secured to the distributor member and extending within a blind bore formed in the drive shaft. The piston is provided with a projection 37 which is urged by the spring into engagement with a seating defined about a short passage communicating with the bore 16 and formed as an extension of the passage 22. The projection 37 and the seating form a spill valve.

When the projection 37 is in engagement with the seating a space is defined between the piston 35 and the end of the cylinder and this space communicates with a passage 38 formed in the distributor member and in constant communication with a passage 39 formed in the sleeve 11.

The annular member 30 is provided with a plurality of radial drillings 40 in which as shown in FIG. 1, are located auxiliary pumping plungers 41 respectively. There are as many auxiliary plungers 41 as there are pumping plungers 17. The plungers 41 have a working clearance with the wall of the drillings 40 so as to minimize fuel leakage and the inner ends of the plungers extend into recesses 42 formed in the periphery of the distributor member, the recesses 42 being of a larger diameter than the plungers. The recesses 42 are in communication with each other by way of a groove 42A formed in the internal surface of the annular member 30 and with a passage 43 formed in the distributor member. The plungers 41 and the pumping plungers 17 are in circumferential alignment with each other so that the plungers 41 engage the shoes 20 of the cam followers 18. Moreover, the passage 43 is drilled from the end of the distributor member so that it passes through the bore 16. It is however closed off by one of the plungers 17. The passage 43 communicates with a circumferential groove 44 which is formed on the periphery of the distributor member and this in turn is in constant communication with a passage 45 formed in the sleeve and extending into the body 10. The passages 39 and 45 can be interconnected by a control valve which is generally seen at 46 in FIG. 1 but which is illustrated in greater detail in FIG. 3. Besides communicating with the groove 44 the passage 43 can also register in turn, with a plurality of supply ports 47 which are formed in the sleeve, and which communicate with the circumferential groove 27.

Figure 3:
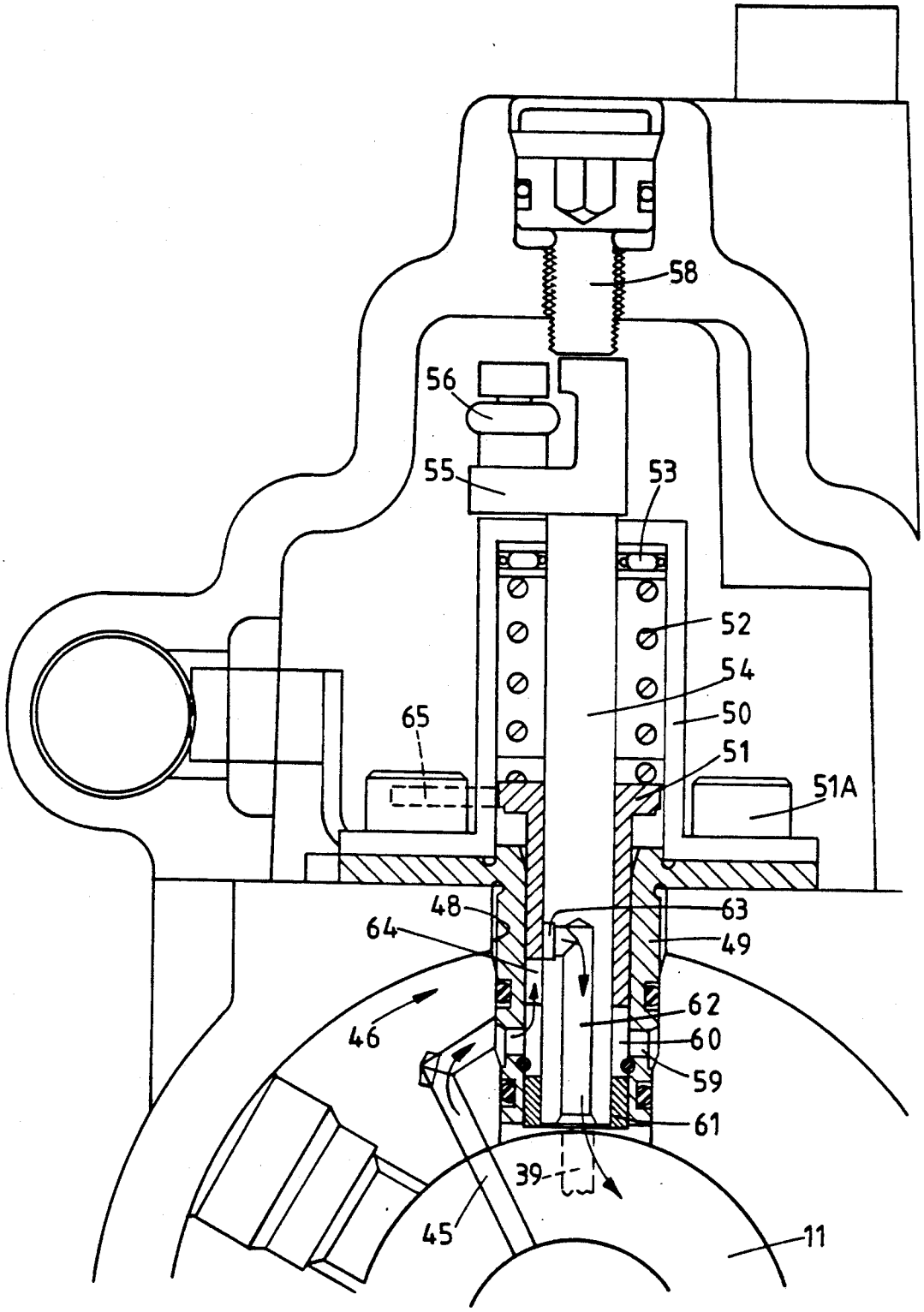
FIG. 3 is a sectional view to an enlarged scale of a further part of the apparatus seen in FIG. 1.

Turning now to FIG. 3 the body defines a radially disposed bore 48 in which is located a flanged sleeve 49. Mounted on the flange of the sleeve is the flange of an enclosure 50 and the enclosure together with the sleeve 49 are secured by bolts 51A to the body of the pump. Slidable within the sleeve 49 is a component in the form of a further sleeve 51 the flange of which lies within the enclosure and is engaged by a coiled compression spring 52, the other end of which engages with a thrust bearing 53 which is located against the base wall of the enclosure. Extending through the enclosure and in sliding engagement with the sleeve 51, is an angularly adjustable rod 54 which exterior of the enclosure is provided with an arm 55 coupled to a mechanical governor by means of a connecting link 56 which is not shown but which is of the usual type comprising weights which are mounted in a cage about the drive shaft and driven thereby, the weights acting through a thrust bearing, against a sleeve which in turn engages an output lever which is shown in FIG. 1 at 57. The lever 57 is coupled to the link 56 and it is also connected to a governor spring, the force exerted by which can be adjusted by the operator of the engine. The rod 54 is also axially adjustable and its position is determined by an adjustable stop 58.

The sleeve 49 is provided with a plurality of ports 59 which provide communication between the passage 45 and an annular space 60 which is defined between the sleeve 49 and the rod 54. The end portion of the sleeve 51 is exposed to the space 60 and the latter is blocked off by means of an annular sealing member 61 which is restrained against axial movement in the direction to reduce the size of the space, by means of a circlip secured within the sleeve 49. Moreover, formed in the rod is an axial passage 62 which communicates with the passage 39 and which opens onto a helical groove 63 formed in the periphery of the rod. In addition, a slot 64 on the end of the sleeve exposed to the space 60, is shaped in a trapezoidal manner and the sleeve 51, besides being axially movable against the action of the spring 52 as will be described, is also angularly adjustable in response to an engine operating parameter. For this purpose it is provided with a laterally extending arm 65 which as is diagrammatically illustrated in FIG. 4, can be connected to a torque control piston 66 or to a pressure responsive capsule 67.

During inward movement of the auxiliary plungers 41, fuel will flow by way of the passage 43, the groove 44 and the passage 45 into the space 60 and the pressure of fuel will effect movement of the sleeve 51 against the action of the spring 52. The area of the sleeve exposed to the fuel pressure and also the strength of the spring determines the actual pressure of the fuel. This pressure is chosen to be sufficiently high to effect movement of the piston 35. During the initial portion of this movement the groove 63 is covered by the sleeve 51 and therefore no fuel will flow into the groove 63. However, as soon as the sleeve has moved sufficiently to uncover the groove 63 fuel can flow through the passage 62 and the passage 39 into the cylinder 34 and the increase in fuel pressure within the cylinder 34 will act upon the piston 35 and will move the piston against the action of the spring 36. As soon as a very limited movement of the piston takes place, the projection 37 will be lifted from the seating which will permit fuel at high pressure to spill from the bore 16 containing the pumping plungers 17, into the cylinder and the pressure of fuel in the bore 16 will reduce to a value which is below that which is required to maintain the valve member of the injection nozzle receiving fuel, in the open position. Flow of fuel to the associated engine will therefore cease and as the two sets of plungers continue to move inwardly, the fuel displaced will effect further displacement of the piston 35 and also the sleeve 51. However, during the further movement no more fuel is supplied to the associated engine. When the rollers move over the crests of the cam lobes, the two sets of plungers are permitted to move outwardly and the fuel previously displaced to the cylinder 34 will be returned to the bore 16 by the action of the spring 36. In addition, the inlet passages 25 will register with the inlet ports 26 and fuel from the outlet of the low pressure pump 28 can also flow into the bore containing the pumping plungers. The spring 52 will also return the sleeve 51 to its original position and such movement will displace fuel from the space 60 back towards the recesses 42 so that the auxiliary plungers will be moved outwardly. In addition, the passage 43 will also register with a supply port 47 and fuel from the low pressure pump will also be supplied to the recesses containing the auxiliary plungers to make up any fuel which may have been lost due to leakage. Thus prior to the commencement of the inward movement of the plungers, both sets of plungers will have been moved outwardly their maximum extent and the sleeve 50 will have moved its maximum extent under the action of the spring 52.

The angular setting of the rod 54 will determine the instant during the movement of the sleeve 51 against the action of its spring, at which the groove 63 is uncovered and it will therefore determine the position during the inward movement of the pumping plungers 17 at which the spillage of fuel from the bore 16 into the cylinder 34 takes place. Thus the angular setting of the rod 54 determines the amount of fuel which is supplied to the associated engine. Adjustment of the axial setting of the rod also has an influence on the quantity of fuel supplied and this is utilized to adjust using the stop 58, the maximum amount of fuel which can be supplied to the associated engine.

The end portion of the slot 64 in the sleeve 51 as already stated, is of a trapezoidal shape and therefore the angular setting of the sleeve 51 will influence the amount of fuel supplied to the engine. If the sleeve 51 is coupled to the torque control piston 66, it can be arranged that with increasing speed, the quantity of fuel which is supplied to the associated engine is reduced. The torque control piston is spring loaded against the pressure of fuel which is developed by the low pressure pump 28. If the sleeve 51 is coupled to the air pressure responsive device 67, then in the case of a turbo charged engine, it can be arranged that the amount of fuel which is supplied to the engine is increased as the output pressure of the turbo charger of the engine increases.

The number of auxiliary plungers 41 is equal to the number of pumping plungers 17 and this ensures that the amount of fuel delivered through the outlets 24 is substantially equal for a given speed and a given setting of the rod 54 irrespective of geometrical variations arising due to manufacturing tolerances.

By the arrangement described the fluid pressure which is required to actuate the spill valve is generated as soon as inward movement of the auxiliary plungers takes place. Moreover this pressure by opening the control valve is applied to the piston. In this manner the generation of shock waves in the apparatus is kept to a minimum. The high pressure fuel circuit is the same as that of a conventional distributor type pumping apparatus in particular, the volume of fuel which is subject to high pressure is substantially the same. Furthermore, the loads which are applied to the governor mechanism are kept to a minimum.

The provision of the annular member 30 with the drillings 40 which form the cylinder walls for the auxiliary plungers 41 allows the passage 22 to be a straight axial passage as in a conventional distributor pump. If the plungers 41 were mounted in the enlarged portion of the distributor member then the bores accommodating the plungers would have to extend to a much greater depth than the recesses 42 to allow fine finishing of the bores. There may not be sufficient wall thickness between the bores and the passage 22 to withstand the pressure of fuel. If the bores are formed as diametrical bores the passage 22 would have to be formed in such a manner as to avoid the bores. Moreover, the annular member provides a very convenient way of providing the drive connection between the distributor member and the drive shaft. The production of the components of the spill valve is also simple. The surface of the bore in the outer fixed member 49 and the internal and external surfaces of the component 51 and the surface of the rod 54 can all be formed to a high surface finish in order to minimize leakage of fuel by conventional machining techniques.

We claim:

1. A fuel pumping apparatus for supplying fuel to an internal combustion engine comprising a rotary distributor member journalled in a pump body and driven in use in timed relationship with the engine, a pumping plunger mounted in a bore in the distributor member, cam means for imparting inward movement to the pumping plunger, a delivery passage communicating with the bore, and the delivery passage registering in turn with a plurality of outlets in the pump body during successive inward movements of the pumping plunger, a spill valve operable to allow fuel to spill from the bore, a fluid pressure operable piston for actuating the spill valve, an auxiliary plunger carried by the distributor member and operated at the same time as the pumping plunger to deliver actuating fluid, and a control valve including a fluid pressure operable component movable by the fluid delivered by the auxiliary plunger, said control valve controlling the application of fluid under pressure to said piston, wherein at a predetermined position in the movement of said component the control valve opens to apply fluid under pressure delivered by said auxiliary plunger to the piston, and said control valve further including an adjustable member operable to vary said predetermined position, thereby allowing the quantity of fuel delivered by the apparatus to be varied.

2. A fuel pumping apparatus for supplying fuel to an internal combustion engine, comprising:

a rotary distributor member journalled in a pump body and driven in use in timed relationship with the engine, a pumping plunger mounted in a bore in the distributor member, cam means for imparting inward movement to the pumping plunger, a delivery passage communicating with the bore, the delivery passage registering in turn with a plurality of outlets in the pump body during successive inward movements of the pumping plunger, a spill valve operable to allow fuel to spill from the bore, a fluid pressure operable piston for actuating the spill valve, and auxiliary plunger carried by the distributor member and operated at the same time as the pumping plungers and a control valve including a fluid pressure operable component movable by the fluid delivered by the auxiliary plunger, said control valve controlling the application of fluid under pressure to said piston, wherein at a predetermined position in the movement of said component the control valve opens to apply fluid under pressure delivered by said auxiliary plunger to the piston, and wherein said control valve includes an outer fixed member defining a cylindrical bore, an inner member in the form of an angularly adjustable rod, said component being of annular form and being slidably located between the inner and outer members, said annular component being exposed at one end to the pressure of fluid delivered by the auxiliary plunger, a spring acting on the component to oppose its movement by fluid pressure and valve means defined by the rod and the component which after a predetermined axial movement of the component and the rod opens to allow the fluid pressure to act on said piston.

3. An apparatus according to claim 2, in which valve means comprises a helical groove formed in the rod and a slot formed in said component, said groove communicating with a cylinder which contains the piston.

4. An apparatus according to claim 3, in which said rod is coupled to a governor mechanism and said component is angularly adjustable by means responsive to an engine operating parameter.

5. An apparatus according to claim 4, in which one end of the spring engages the component and the other end of the spring is engaged with a thrust bearing supported by a fixed member.

6. A fuel pumping apparatus for supplying fuel to an internal combustion engine, comprising:

a rotary distributor member journalled in a pump body and driven in use in timed relationship with the engine, a pumping plunger mounted in a bore in the distributor member, cam means for imparting inward movement to the pumping plunger, a delivery passage communicating with the bore, the delivery passage registering in turn with a plurality of outlets in the pump body during successive inward movements of the pumping plunger, a spill valve operable to allow fuel to spill from the bore, a fluid pressure operable piston for actuating the spill valve, an auxiliary plunger carried by the distributor member and operated at the same time as the pumping plungers and a control valve including a fluid pressure operable component movable by the fluid delivered by the auxiliary plunger, said control valve controlling the application of fluid under pressure to said piston, wherein at a predetermined position in the movement of said component the control valve opens to apply fluid under pressure delivered by said auxiliary plunger to the piston, and wherein said auxiliary plunger is housed in a drilling formed in an annular member surrounding the distributor member, the distributor member defining a blind recess into which the inner end of the auxiliary plunger can extend in use.

7. An apparatus according to claim 6, including a drive block carried by the annular member said drive block defining a first portion which is engaged within a slot formed in the distributor member and a second portion which is engaged within a slot formed in a drive shaft which extends about a part of the distributor member.

* * * * *